US007845434B2

(12) United States Patent
Clayton

(10) Patent No.: US 7,845,434 B2
(45) Date of Patent: Dec. 7, 2010

(54) TECHNIQUE FOR DRILLING STRAIGHT BORE HOLES IN THE EARTH

(75) Inventor: Charley H. Clayton, Portland, TX (US)

(73) Assignee: Troy Lee Clayton, Portland, TX (US)

( * ) Notice: Subject to any disclaimer, the term of this patent is extended or adjusted under 35 U.S.C. 154(b) by 136 days.

(21) Appl. No.: 11/082,073

(22) Filed: Mar. 16, 2005

(65) Prior Publication Data

US 2006/0207801 A1 Sep. 21, 2006

(51) Int. Cl.
*E21B 17/10* (2006.01)
*E21B 17/16* (2006.01)
*E21B 17/12* (2006.01)

(52) U.S. Cl. ..... 175/325.1; 166/241.1

(58) Field of Classification Search ..... 175/325.2, 175/325.5, 325.1; 166/241.1, 241.2
See application file for complete search history.

(56) References Cited

U.S. PATENT DOCUMENTS 2,829,864 A * 4/1958 Knapp ..... 175/325.2
3,250,578 A * 5/1966 Lubbes ..... 175/325.2
3,784,238 A * 1/1974 Chance et al. ..... 285/288.1
3,916,998 A * 11/1975 Bass et al. ..... 166/301
3,938,853 A 2/1976 Jurgens et al.
4,416,476 A * 11/1983 Garrett ..... 285/288.1
4,460,202 A * 7/1984 Chance et al. ..... 285/333
4,674,580 A * 6/1987 Schuh et al. ..... 175/325.2
4,811,800 A * 3/1989 Hill et al. ..... 175/323
4,874,045 A * 10/1989 Clayton ..... 175/57
5,150,757 A * 9/1992 Nunley ..... 175/323
5,474,143 A 12/1995 Majkovic
5,542,454 A * 8/1996 Carlson et al. ..... 138/110
5,697,460 A * 12/1997 Stewart et al. ..... 175/325.5
6,012,744 A * 1/2000 Wilson et al. ..... 285/288.1
6,349,779 B1 * 2/2002 Gilbert ..... 175/323
6,782,921 B1 * 8/2004 Tsuru et al. ..... 138/142
7,225,868 B2 * 6/2007 Arai et al. ..... 166/277
2004/0035576 A1 * 2/2004 Arai et al. ..... 166/206
2007/0119626 A9 * 5/2007 Giroux et al. ..... 175/61

OTHER PUBLICATIONS

SMF International, Drill Collars, Mar. 5, 2004, 3 pages.*
Smith Services, Drill Collars-Standard & Sprial, Aug. 17, 2004, 5 pages.*

* cited by examiner

*Primary Examiner*—Shane Bomar
*Assistant Examiner*—Brad Harcourt
(74) *Attorney, Agent, or Firm*—G. Turner Moller

(57) ABSTRACT

A stabilizer assembly is at least 12' long and preferably at least 14' long and is used to drill a straight bore hole in the earth. A central passage through the assembly closely follows a centerline as may be determined by measuring the wall thickness of the tube at a variety of locations in a single plane. At least three stabilizing sections are integral with the tube and include alternating ribs and flutes. Hardbanding on the ribs is ground down to tolerances with a grinding machine or face plate lathe having centers sufficient to receive the 12' long stabilizer assembly.

13 Claims, 1 Drawing Sheet

TECHNIQUE FOR DRILLING STRAIGHT BORE HOLES IN THE EARTH

This invention relates to a technique for drilling straight bore holes in the earth and more particularly to a stabilizer assembly and a method of making and using the same.

BACKGROUND OF THE INVENTION

As discussed at some length in U.S. Pat. No. 4,874,045, the art of drilling bore holes in the earth has evolved substantially. Initially, a bit was simply threaded onto the end of drill pipe and the resultant bore hole meandered significantly into the earth, typically in a corkscrew manner. At the present time, an attempt to drill a relatively straight vertical bore hole in the earth incorporates an elaborate bottom hole assembly including a series of stabilizers above the bit and a long length of drill collars above and interspersed between stabilizers.

It has become more desirable to drill straight vertical bore holes in the earth as wells are being drilled deeper. This is because of increased friction generated between rotating drill pipe and the bore hole. One can easily visualize that rotating drill pipe from the surface in a 20000' well consumes considerably more horsepower than in a 5000' well. Even where wells are drilled with a mud motor, drill pipe is also preferably rotated from the surface in order to increase the rate of penetration. Unduly meandering bore holes, and the friction generated thereby, are accordingly a much greater problem as well depths increase.

Disclosures of interest relative to this invention are found in U.S. Pat. Nos. 3,250,578; 3,938,853; 4,874,045; 5,474,143 and 5,697,460.

SUMMARY OF THE INVENTION

In this invention, a stabilizer is at least 12' and preferably us at least about 14' long and ideally is at least about 16' long and includes a tube and at least three stabilizing sections integral with the tube. The stabilizer is very well balanced, meaning that rotation of the stabilizer during drilling creates very small lateral forces on the stabilizer and therefore causes very little eccentric motion, or whip, of the stabilizer during rotation.

The stabilizer is balanced mainly by making the inner and outer diameters very concentric to the tube centerline. This is accomplished by providing a cylindrical axial passage that is on the centerline of the tube, subject to very close tolerances, and a cylindrical exterior surface between the stabilizing sections that has been ground or machined to be concentric, subject to very close tolerances, to the tube centerline. Because of the small tolerances of the interior and exterior of the stabilizer, the wall thickness of the stabilizer is very consistent so the stabilizer is very well balanced, meaning there is very little whip or eccentricity during rotation.

The stabilizing sections are integral with the tube or cylindrical part of the stabilizer. This is accomplished by removing material from the blank after the axial passage has been bored. Flutes are then machined in the stabilizer sections to form ribs integral with the tube, by which is meant that the ribs are not welded or secured by fasteners to the body of the tube. The outer diameter of the ribs is somewhat less than the desired finished outer diameter to allow hardbanding followed by grinding or machining of the outer diameter to bring it to tolerance.

It is exceedingly difficult to make a long stabilizer with integral stabilizing sections to very close tolerances. It will be understood that a long stabilizer is stiffer and thus less likely to create a meandering bore hole than two short stabilizers coupled by a threaded connection. The reason, of course, is that no threaded connection is as stiff as unmachined stock of the same inner and outer diameters. All stabilizers currently manufactured for the drilling of hydrocarbon wells have maximum lengths approaching 8½'. The reason is that the grinding machines used to dress the external diameter have 8½' centers, meaning that longer stock cannot be chucked into the machine. It is almost beyond comprehension to understand how difficult it is to find and acquire, on a basis that makes economic sense, a grinding machine or face plate lathe having 12' or 16' centers. Such equipment is massive, prohibitively expensive when new, and awkward to ship and install. Only an obsessive attention to detail would overcome the difficulties.

Seemingly, the main goal of this invention is to drill straight holes. This is not correct because drilling straight holes at unduly slow speeds is not acceptable to the industry because the total cost of drilling a well is directly proportional to the time it takes to drill it. Thus, the main goal of this invention is to drill straight holes at high rates of penetration.

It is an object of this invention to provide an improved method and apparatus for drilling a straight vertical bore hole in the earth.

A further object of this invention is to provide an improved stabilizer for use in a bottom hole assembly.

A more specific object of this invention is to provide a one piece stabilizer that is much longer than conventional stabilizers for use in drilling bore holes in the earth.

These and other objects and advantages of this invention will become more apparent as this description proceeds, reference being made to the accompanying drawings and appended claims.

DETAILED DESCRIPTION

Figure 3:
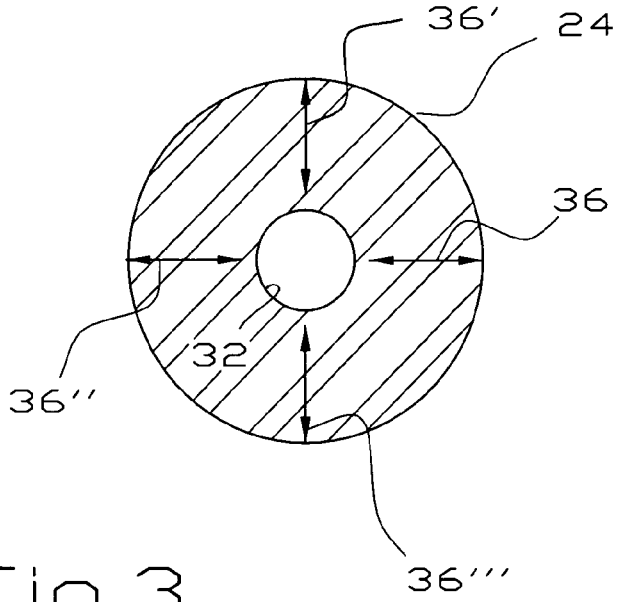
FIG. 3 is an enlarged cross-sectional view of the stabilizer of FIG. 1, taken substantially along line 3-3 thereof through the tube, as viewed in the direction indicated by the arrows.
Figure 2:
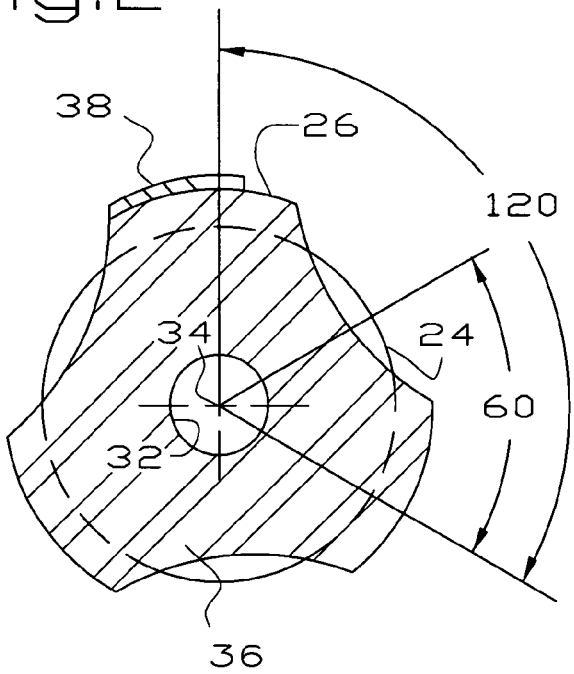
FIG. 2 is an enlarged cross-sectional view of the stabilizer of FIG. 1, taken substantially along line 2-2 thereof through a stabilizer section, as viewed in the direction indicated by the arrows.
Figure 1:
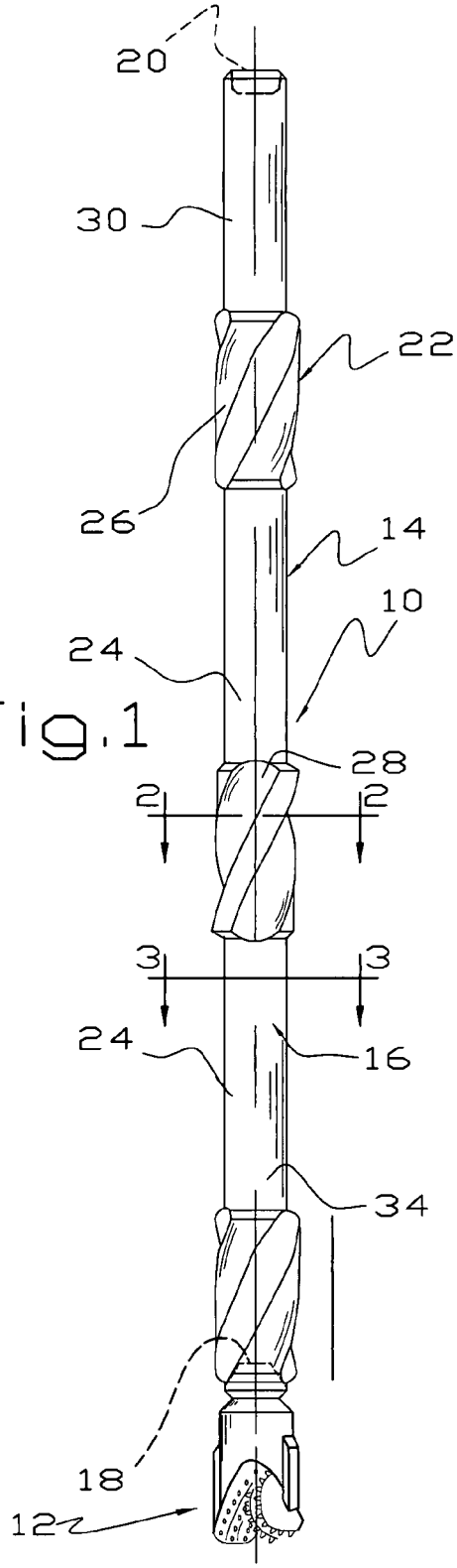
FIG. 1 is a side view of a stabilizer of this invention coupled to a bit for drilling a bore hole in the earth.

Referring to FIGS. 1-3, there is illustrated a drilling assembly 10 comprising a bit 12 and a bottom hole or stabilizer assembly 14. The bit 12 may be of any suitable type such as a cone-roller bearing type, a conventional diamond bit or a polycrystalline insert type. The stabilizer assembly 14 is made of one piece of metal and comprises a central tube 16 having a threaded female connection or box 18 at one end into which the bit 12 is threaded and another threaded female connection or box 20 at the other end for connection to a drill collar joint (not shown), another stabilizer (not shown) or other oil field tubular. At least three stabilizer sections 22 are located on the exterior of the tube 16 and are separated by cylindrical sections 24. The stabilizer sections 22 are of a larger outer diameter than the tube 16 and preferably provide helical ribs 26 and flutes 28 for swirling drilling mud as it passes upwardly away from the bit 12. A fishing neck 30 at the upper end of the stabilizer assembly 14 allows a washover pipe to pass over the top of the assembly 14 if it becomes detached or is shot off in a well.

The tube 16 provides a central passage 32 that is as concentric as reasonably possible relative to a centerline 34. The purpose of the concentric central passage 30 is to reduce the amount of lateral motion, or whip, when the stabilizer assembly 14 is rotated during drilling. One way of measuring the concentricity of the passage 32 is by measuring the wall thickness 36, 36', 36", 36"' of the tube 16 in a plane at various radial locations around the centerline 34 and comparing the measurements, as suggested in FIG. 3. In this invention, the measured wall thicknesses of the tube 16 will not vary by more than 0.050" and, preferably, the wall thickness of the tube 16 does not vary by more than 0.025" and, ideally, the wall thickness of the tube 16 does not vary by more than 0.010". This is not easy to do in a stabilizer assembly that is 8½' long and is a complicated and difficult problem in a stabilizer assembly 12' long or longer. Centrally located passages 28 may be drilled to such tolerances by firms such as Boring Specialities of Houston, Tex.

After the metal blank is bored to provide the central passage 28, metal is removed from the blank in the area of the cylindrical sections 24 by machining on a face plate lathe or by grinding on a grinding machine. This is accomplished by advancing the cone shaped centers of the grinding machine toward each other until they touch, or nearly touch, to determine that their centerlines are aligned. Then, the centers are retracted until they are further apart than the blank to be worked upon. The blank, having the passage therethrough that is centered as nearly as possible, is placed in the face plate lathe or grinding machine so the cone shaped centers enter the passage and thereby center the blank on the machine. The cylindrical sections 24 are then ground, or machined, to remove any eccentricity so the blank is much better balanced than is provided simply by having a bored passage nearly on the blank centerline. After these steps, the wall thickness of the blank, between the inner and outer diameters, as taken in a common plane typically varies no more than 0.005" and is usually less than 0.002".

Because the stabilizer assembly 14 is at least 12' long, preferably at least 14' long, and ideally about 16' long, a grinding machine or face plate lathe must be large enough to receive a metal piece of this length. Grinding machines or face plate lathes of this size are not easy to find in any machine shop environment, are expensive when new and are awkward to transport and install. At the present time, there are no grinding machines or face plate lathes available in machine shops catering to the oil service industry to accomplish the desired grinding or machining of the stabilizer sections 22 in a stabilizer assembly of the length of the present invention.

After the cylindrical sections 24 have been formed, the stabilizer sections 22 remaining on the tube 16 are machined to form the flutes 28. This is done in a conventional manner, i.e. by rotating the blank slightly as it moves past the cutting implements.

The exterior surface of the ribs 26 are initially slightly smaller than the desired outer diameter of the stabilizer sections 22. Hardbanding 38 is applied to the ribs 26 in a conventional manner, typically by electric arc welding of rods or wire including tungsten carbide particles so that the tungsten carbide particles are embedded in the hardbanding 38. The thickness of the hardbanding 38 is sufficient to make the ribs 26 larger than the desired outer diameter. The stabilizer assembly 10 is then placed in a grinding machine or face plate lathe having centers sufficiently far apart to accept the assembly 10 and the surface of the stabilizer sections 24 ground or machined to remove enough hardbanding 38 to make the stabilizer sections 22 of the desired diameter. Prototypes of this invention have been made using a cylindrical grinder known as a Norton Model D Landis 36"×192" S.N. 15684 that was last used as a grinder for drive shafts of submarines and other large marine vessels. At some time in the process of manufacture, the female threads 18, 20 are machined into the ends of the blank.

As explained in U.S. Pat. No. 4,874,045, it is desirable to match the outside diameter of the bit 12 with the outside diameter of the stabilizer 14 so that the bit 12 is only slightly larger than the stabilizer assembly 14. By either grinding the exterior of the bit 12 or by grinding the exterior of the stabilizer assembly 14, the bit 12 ends up being 0.003-0.045 inches larger than the outside diameter of the stabilizer assembly 14.

By making the stabilizer 10 of greater length, it is stiffer than a comparable joint of stabilizers threaded together. By making the stabilizer 10 balanced about its centerline, there is much less wobble or lateral motion of the stabilizer. Both modifications promote drilling of straight holes.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A one piece stabilizer assembly having a central tube at least 12' long providing an axial cylindrical passage concentric with a centerline of the tube, at least three stabilizing sections integral with the tube providing ribs extending away from the tube, the tube providing an external cylindrical surface between the stabilizing sections, the axial passage and the external cylindrical surface providing a wall thickness of the tube, the wall thickness, as measured at a multiplicity of radially spaced locations at a multiplicity of axially spaced locations along the tube, varying no more than about 0.025".

2. The one piece stabilizer of claim 1 wherein the wall thickness varies no more than 0.010".

3. The one piece stabilizer of claim 1 wherein the stabilizer is at least 14' long.

4. The one piece stabilizer of claim 1 wherein the stabilizer is at least 16' long.

5. The one piece stabilizer of claim 1 wherein the tube provides a female threaded connection at a first end for receiving a bit and a female threaded connection at a second end for receiving a threaded pipe joint.

6. The one piece stabilizer of claim 5 further comprising a bit threaded into the female connected on the first end, the bit having an outer diameter in the range of 0.003-0.045 inches larger than the stabilizer section.

7. The one piece stabilizer of claim 1 wherein the ribs have hardbanding thereon which has been applied and then removed to a predetermined diameter.

8. A one piece stabilizer assembly having a single central tube providing an axial cylindrical passage concentric with a centerline of the tube having an upper end providing a first threaded connection and a lower end providing a second threaded connection for receiving a drilling bit, at least three stabilizing sections integral with the tube providing ribs extending away from the tube, a lowermost of the sections juxtaposing the second threaded connection, an uppermost and an intermediate of the sections being spaced along the central tube, the ribs having hardbanding thereon which has been applied and then removed to a predetermined diameter, the tube providing an external cylindrical surface between the stabilizing sections, the axial passage and the external cylindrical surface providing a wall having a thickness varying no more than about 0.025" as measured at a multiplicity of radially spaced locations at a multiplicity of axially spaced locations along the tube.

9. The one piece stabilizing assembly of claim 8 wherein the lowermost stabilizing section comprises helical flutes and helical ribs.

10. The one piece stabilizing assembly of claim 8 wherein the wall thickness, as measured along the tube, varies no more than about 0.025".

11. The one piece stabilizing assembly of claim 8 wherein the central tube is at least 12' long.

12. The one piece stabilizing assembly of claim 8 wherein the second threaded connection comprises a female threaded connection.

13. The one piece stabilizing assembly of claim 12 wherein the first threaded connection comprises a female threaded connection.

* * * * *